United States Patent [19]

Altenweger

[11] 4,164,805

[45] Aug. 21, 1979

[54] APPARATUS FOR DIVIDING WARPS WITH LEASES

[75] Inventor: Alois Altenweger, Uster, Switzerland

[73] Assignee: Zellweger Uster Ltd., Uster, Switzerland

[21] Appl. No.: 887,437

[22] Filed: Mar. 16, 1978

[30] Foreign Application Priority Data

Jun. 24, 1977 [CH] Switzerland ..... 7762/77

[51] Int. Cl.[2] ..... D03G 1/16

[52] U.S. Cl. ..... 28/202

[58] Field of Search ..... 28/198, 199, 211, 201, 28/202

[56] References Cited

U.S. PATENT DOCUMENTS

| | | | |
|---|---|---|---|
| 2,011,115 | 8/1935 | Peterson | 28/211 |
| 2,907,092 | 10/1959 | Altenweger | 28/202 |
| 3,197,838 | 8/1965 | Fauring | 28/202 |
| 3,378,899 | 4/1968 | Gronert | 28/211 |
| 3,432,897 | 3/1969 | Baumgartner | 28/198 |
| 3,879,824 | 4/1975 | Mizuno | 28/211 |

*Primary Examiner*—Henry Jaudon

*Attorney, Agent, or Firm*—Werner W. Kleeman

[57] ABSTRACT

An apparatus for dividing warps by means of leases, which is of the type having divider elements for the momentary edge warp end or thread and a feeder for the divided or separated threads for feeding such threads to tying elements. The divider elements separate the edge warp thread from the warp sheet in that the divider or separator elements, together with lease cords defining the lease following the separation of a thread, change their position relative to the warp sheet in such a manner that all threads following the edge warp thread are displaced away therefrom and the feeder only then moves through the complete path needed for the infeed of the separated thread to the tying elements when in fact a thread has been separated. Means ensure that the divider elements only then change their position relative to the warp sheet when the feeder has moved theough its complete path.

7 Claims, 1 Drawing Figure

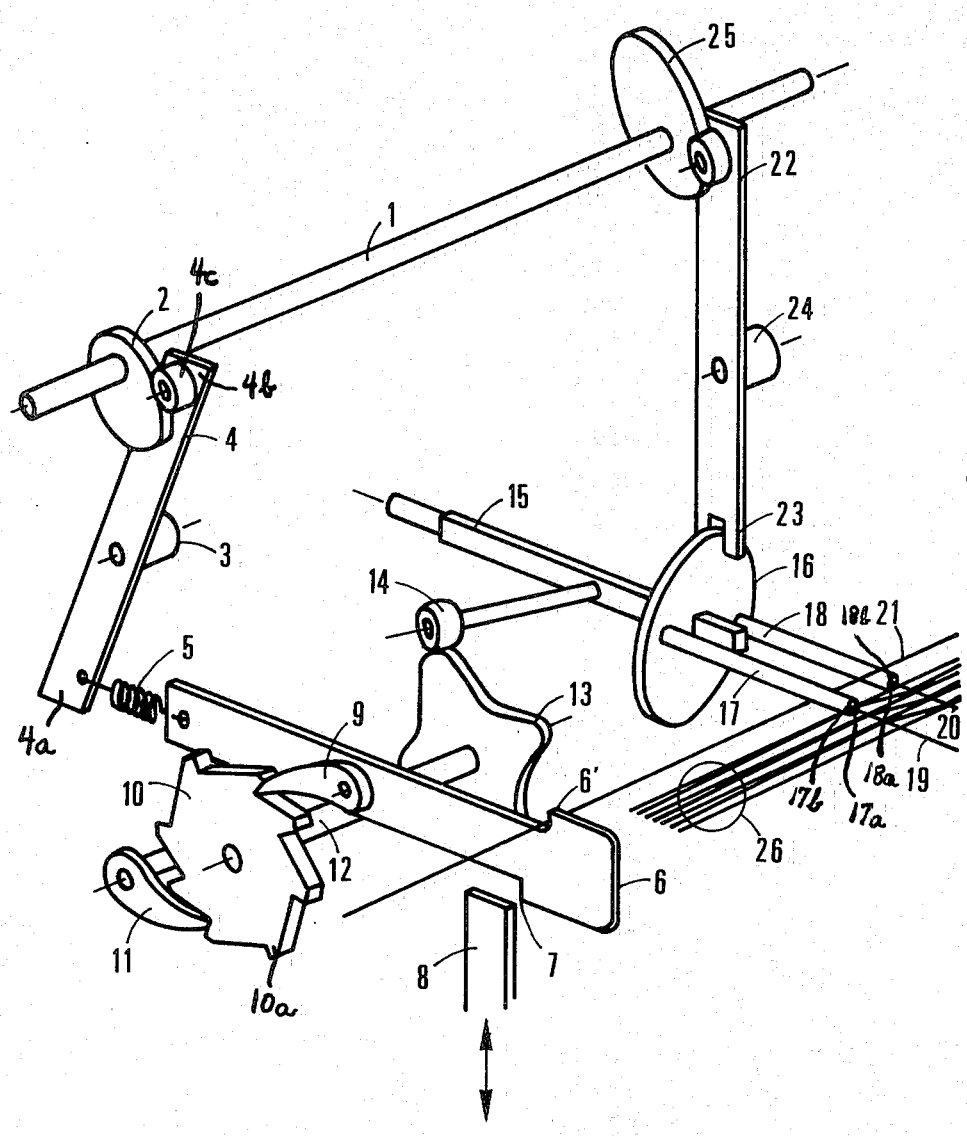
25
22
1
4c
2
24
4b
4
15
23
3
16
14
18
18b
21
5
13
17
9
20
4a
6'
18a
19
10
17b
17a
26
12
6
11
8
7
10a

APPARATUS FOR DIVIDING WARPS WITH LEASES

BACKGROUND OF THE INVENTION

The present invention relates to a new and improved construction of apparatus for separating or dividing warp ends or threads by means of leases.

Equipment for separating warp ends or warp threads by means of leases and having separator or divider elements for the momentary edge warp end and a feeder device for feeding the separated thread to tying elements, is well known in the art. One constructional embodiment of such type equipment has been disclosed, for instance, in Swiss Pat. No. 348,937, to which reference may be readily had. This prior art apparatus embodies a control for pivoting (raising and lowering) the lease cords inserted into the sheet of warp or warp ends, which is rigidly coupled with the work cycle of the equipment. In other words, the position of the lease cords is then also changed when, for instance, no thread is to be separated or divided and the separation operation is to be repeated. However, upon the occurrence of double threads, conventional equipment cannot be expected to interrupt the position change of the lease cords until elimination of the double thread problem. In both instances the consequence of such is that the warp threads or ends of the warp which is to be separated or divided are united in a false thread combination.

SUMMARY OF THE INVENTION

Hence, it is a primary object of the present invention to overcome the aforementioned drawbacks and limitations existing with the prior art as previously explained.

Another and more specific object of the present invention aims at a new and improved construction of apparatus for the separation or dividing of warp ends by means of leases in a manner not associated with the previously discussed limitations and drawbacks, and wherein such apparatus is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the apparatus of the present invention for the separation of warp ends or warp threads by means of leases, comprises separation or divider elements for the separation of the momentary edge warp thread and a thread feeder or infeed device for the separated thread for feeding such threads to tying elements. The divider elements separate the edge warp thread from the sheet of warp or warp ends in that these divider elements, in conjunction with the lease cords defining the lease, and following the separation of a thread, change their position relative to the warp sheet in such a manner that all threads following the edge warp thread are displaced away therefrom and the feeder only then moves through the complete path needed for the infeed of the separated thread to the tying elements when there has in fact been separated a thread. According to important aspects of the invention, means serve for only then changing the position of the divider elements relative to the warp sheet when the feeder has moved through its complete path.

BRIEF DESCRIPTION OF THE DRAWINGS

The invention will be better understood and objects other than those set forth above, will become apparent when consideration is given to the following detailed description thereof. Such description makes reference to the annexed drawing wherein the single FIGURE schematically illustrates an exemplary embodiment of apparatus for separating warp threads by means of leases as contemplated by the present invention.

DETAILED DESCRIPTION OF THE PREFERRED EMBODIMENTS

Describing now the drawing, in the single FIGURE there has been shown apparatus for separating or dividing warp threads by means of leases, there having been only shown enough of the structure of the equipment, to simplify the illustration, as necessary for those skilled in the art to fully understand the underlying concepts and principles of the present invention. Hence, it will be seen that a control shaft 1, which is coupled with a standard (and therefore not particularly shown) dividing and tying drive, carries a first cam 2 or equivalent structure. This cam 2 controls a double-arm pivotable lever 4 which is rotatably mounted in a bearing or support 3. The end 4*a* of the double-arm lever 4 which is remote from the end 4*b* which coacts by means of a cam follower roll 4*c* with the cam 2 is suspended by means of a spring 5 at a divider or separator rod 6 equipped with a feeder or feeder means 6'. As long as the divider or separator rod 6 is not blocked, it carries out a to-and-fro movement, and during each forward movement thereof an edge warp thread or warp end 21 is engaged by the feeder 6' and presented to conventional and therefore not particularly shown tying elements. A locking or blocking element 8 coacting with a blocking nose 7 provided at the divider or separator rod 6 is controlled by conventional up-and-down drive means indicated by the double-headed arrow in the drawings in such a manner that such divider rod 6 is prevented from carrying out its forward motion when no edge or end warp thread 21 is engaged. Then, the path of the pivotal lever 4 is taken up by tensioning the spring 5.

A pawl 9 pivotably connected with the divider rod 6 cooperates with a ratchet wheel 10 having the ratchet teeth 10*a*, in that such pawl 9, during each complete forward movement of the divider rod 6, rotates the ratchet wheel 10 through one tooth division. A conventional holding pawl 11 prevents any return rotation of the ratchet wheel 10 during the reverse or return movement of the divider rod 6 into its starting position. Now if the divider rod 6 is prevented from carrying out its forward motion due to engagement of the locking element 8 with the blocking nose 7, then the pawl 9 also cannot further rotate the ratchet wheel 10. A star wheel 13 or equivalent structure is operatively connected by means of a shaft 12 with the ratchet wheel 10.

A feeler or scanner lever 14 which is attached to a rotatable or pivotable rod 15 scans the contour of the star wheel 13 and thus rocks the rotatable rod 15. The rotatable rod 15 possesses a non-circular profile or cross-section in order to transmit to a disk 16 which is seated thereon to be lengthwise displaceable, the rocking or pivotal motion carried out by the feeler or scanner lever 14. The disk 16 carries so-called lease tubes or hollow tubular members 17 and 18, defining thread divider or separator elements, through the bores 17*a* and 18*a* of which there are guided leases or lease means in the form of lease cords 19 and 20, respectively, or equivalent structure. Hence, as will be apparent, these lease cords 19 and 20 will be alternately raised and lowered as a function of the position of the star wheel 13, so that in each instance the momentary edge warp end will be separated and freed from the remaining warp sheet 26 and prepared for the separating or dividing operation.

Apart from imparting to the disk 16 its rotational or rocking movement by means of the feeler lever 14 and the rotatable or pivotal rod 15, there is imparted to such disk 16 an axial displacement, by mechanism to be described more fully hereinafter. As a result, the warp ends or threads of the warp sheet 26, with the exception of the edge warp thread 21, are pushed back upon the lease cords 19 and 20, in that the end surfaces or ends **17*b* and 18*b* of the lease tubes 17 and 18, respectively, hold back the warp threads which bear upon the lease cords. The displacement movement of the disk 16 is accomplished by means of a displacement or actuating lever 22 which is rotatably mounted in a bearing or support 24 and by means of a cam disk 25 or equivalent structure which is seated upon the control shaft 1, imparts an oscillatory or pendulum motion to the disk 16. The bifurcated end 23 of the displacement or actuating lever 22 straddles the disk 16 and therefore imparts to the latter the aforementioned oscillatory or shifting movement lengthwise of the rotatable or pivotable rod 15**.

By virtue of the fact that the locking or blocking element 8 prevents the forward movement of the thread divider rod 6, when no edge warp thread is to be separated, the further pivotal movement of the disk 16 is also interrupted since the ratchet wheel 10 is not further rotated. Only when the divider rod 6 again is freed are the lease cords 19 and 20 again raised and lowered.

The operation of lease tubes 17 and 18 in conjunction with lease cords 19 and 20 are known in the art, similar to those of U.S. Pat. No. 2,907,092, and therefore are not claimed alone as any novel part of the present invention.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for separating warp threads by means of leases, comprising:

thread divider elements for separating an edge warp thread from a sheet of warp threads;

thread feeder means, being a part of a movable divider rod, for delivering the separated warp thread to tying means;

lease means provided for said warp threads;

means for controlling operation of said divider elements such that said divider elements in conjunction with said lease means, following the separation of an edge warp thread, change their position relative to the sheet of warp threads in such a manner that all warp threads, following the separated edge warp thread, are displaced toward the sheet of warp threads;

means for enabling said thread feeder means to only then move through its complete path needed for the feed of the separated warp thread to the tying means when there has been actually separated an edge warp thread;

said means for controlling operation of said divider elements incorporating means for ensuring that said divider elements only then change their position relative to the sheet of warp threads when the thread feeder means has moved through said complete path;

said movable divider rod being equipped with a blocking nose;

said enabling means including locking means coacting with said blocking nose for blocking said divider rod;

said divider rod separating the edge warp thread as soon as said locking means is out of engagement with said blocking nose;

said ensuring means including a pawl and ratchet wheel cooperating with said divider rod; and said ratchet wheel being indexed by said pawl whenever said divider rod separates the edge warp thread.

2. The apparatus as defined in claim 1, wherein:

said locking means can engage with said blocking nose in order to block movement of said divider rod; and said ratchet wheel remaining in its assumed position whenever said divider rod is blocked by said locking means engaging with said blocking nose.

3. The apparatus as defined in claim 2, further including:

means for the displacement of said divider rod; and said displacement means includes an expansible element for driving said divider rod.

4. The apparatus as defined in claim 3, wherein:

said expansible element comprises spring means.

5. The apparatus as defined in claim 1, wherein:

said means for controlling operation of said divider elements comprises a star wheel;

means for operatively connecting said ratchet wheel with said star wheel;

a feeler lever bearing at the circumference of said star wheel and rocked during movement of said star wheel.

6. The apparatus as defined in claim 5, wherein:

said lease means comprises lease cords;

said divider elements comprising tube means through which guidingly extend said lease cords;

disk means carrying said tube means; and said feeler lever rocking said disk means.

7. The apparatus as defined in claim 6, further including:

means for moving said disk means in axial direction of said tube means.

* * * * *